US007509990B1

(12) United States Patent
Milligan

(10) Patent No.: US 7,509,990 B1
(45) Date of Patent: Mar. 31, 2009

(54) GARAGE SHADE

(76) Inventor: Loren Milligan, 102 N. Main, Baxter, IA (US) 50028

( * ) Notice: Subject to any disclaimer, the term of this patent is extended or adjusted under 35 U.S.C. 154(b) by 289 days.

(21) Appl. No.: 11/403,126

(22) Filed: Apr. 13, 2006

(51) Int. Cl.
*E06B 3/48* (2006.01)

(52) U.S. Cl. ..... 160/113; 160/201

(58) Field of Classification Search ..... 160/113, 160/201, 205, 290.1, 327, 354, 368.1
See application file for complete search history.

(56) References Cited

U.S. PATENT DOCUMENTS 1,606,401 A * 11/1926 Craft ..... 211/1
2,840,158 A * 6/1958 Lee ..... 160/327
3,004,592 A * 10/1961 Norton ..... 160/114
3,044,540 A 7/1962 Hammersley
3,126,944 A 3/1964 Kempinski
3,455,366 A * 7/1969 Bogumil ..... 160/368.1
3,497,998 A 3/1970 Thomas
3,756,641 A * 9/1973 Dugan ..... 292/258
3,911,992 A * 10/1975 Webb ..... 160/290.1
4,301,851 A 11/1981 Gitkin
4,345,448 A * 8/1982 Solomon ..... 70/95
4,653,566 A 3/1987 Miale
5,271,449 A * 12/1993 Herrick ..... 160/368.1
5,427,169 A * 6/1995 Saulters ..... 160/368.1
5,611,382 A 3/1997 Sferra
5,765,622 A * 6/1998 Lichy ..... 160/273.1
5,860,465 A * 1/1999 Eastridge et al. ..... 160/113
5,996,666 A 12/1999 Denina
6,092,580 A * 7/2000 Lucas ..... 160/113
6,296,041 B1 * 10/2001 Cicero ..... 160/327
6,330,898 B1 * 12/2001 Chang ..... 160/24
6,463,989 B1 * 10/2002 Johnson ..... 160/201
6,557,614 B1 5/2003 Lampers
6,802,551 B2 * 10/2004 Nelson ..... 296/24.41
2004/0020607 A1 * 2/2004 Aguirre et al. ..... 160/113

* cited by examiner

*Primary Examiner*—David Purol
(74) *Attorney, Agent, or Firm*—G. Brian Pingel; Camille L. Urban; Jason R. Jenkins

(57) ABSTRACT

The present invention is a garage door shade assembly to be used in conjunction with an overhead, garage door that moves on tracks from open to closed position. The shade is frameless and it upper edge is affixed to the lowest edge of the garage door. When the shade is retracted, the lower edge of the shade is removable secured to an upper boundary of the lowest garage door panel. When the shade is extended, that lower edge is released from its association with the upper boundary of the lowest garage door panel, and the door is raised the desired level. Finally, the lower edge of the shade can be secured in its vertical position by associating it with the tracks of the door.

8 Claims, 6 Drawing Sheets

GARAGE SHADE

BACKGROUND OF THE INVENTION

1. Field of the Invention

The present invention relates generally to overhead garage doors and, more specifically, to a shade to partially cover a garage door opening and provide a pet exit deterrent.

2. Description of the Prior Art

Screens and shades used in conjunction with garage door openings are not new in the art. Some shades include a device that extends outward from the garage and is supported by legs wherein a portion of the driveway is shaded as well as the interior of the garage. See U.S. Pat. Nos. 3,497,998; 4,301,851; 5,996,666. Others employ a full screen door used to cover the entire garage door opening. See U.S. Pat. Nos. 3,044,540; 3,126,944. Into some garage doors are incorporated screen panels. And, finally, some employ screened sections reflective of the panel size of the garage door and which use track and ball mechanics to effect slidably raising and lowering the screen panel relative to the garage door. See U.S. Pat. Nos. 4,653,566; 5,611,382; 6,557,614 (B1).

Related art screens are often specifically sized to the garage door sections so they lack flexibility and provide only one dimension of screened or shaded area. Often the purpose of related art is to provide screens but not shade, however, in addition to improving air circulation there is often a need to block the majority of sunlight. Finally, the association of the screen or shade with the door and the garage floor in related art is often more complex than necessary and not sufficient to deter a child's or a pet's exit and, therefore, cannot be used when a child or a pet is present in the garage.

It is a first object of the present invention to provide a shade that may be of any or of a variety of lengths;

It is a second object of the present invention to provide a shade that is secured in a manner such that children and most kinds of pets are secured in the garage;

It is a third object of the present invention to provide a shade that is flexible and light;

It is a fourth object of the present invention to provide a shade that is simple to retract and extend and simple to mount;

It is a fifth object of the present invention to provide a shade that minimizes visibility into the garage from the outside; and Finally, it is an object of the present invention to provide a versatile shade for a door-to-floor shade or a partial shade near the top of the open door.

SUMMARY OF THE INVENTION

The present invention incorporates a flexible, frameless shade section attached at its upper edge near the bottom of a garage door. When not in use, the lower edge of the shade section is folded to overlay the bottom section of the garage door and attached near the upper edge and interior side of that section. To use, the lower edge of the shade section is disengaged from the door and the door is raised such that the lower edge of the shade is adjacent the garage floor. Or, if desired, the door is raised to an upper position allowing the shade to partially cover the opening providing the desired amount of shade in the garage while still allowing entry and exit.

In the preferred embodiment, the upper edge of the shade includes a rigid bar. The bar runs the full width of the garage door and is semi-permanently associated with the door by self-tapping screws. The lower edge of the shade accommodates a rigid member approximately the same width as the garage door. When the shade is extended, the member acts as a securing device for the bottom of the shade. When the shade is retracted, the rigid member is engaged by hand-operated friction-fit clamps to maintain the shade in its retracted position. Other methods to quick couple the door and the rigid member may be employed, as well.

The shade is air permeable and so improves air flow through the garage while blocking light and limiting visibility into the garage from the outside. Although not its main purpose, the majority of bugs and leaves will be kept outside the garage when the shade is extended to the garage floor. No sliding mechanism or track and ball mechanics are used. There is no motor or remote control necessary. The screen may be of any desired length whereupon the shade can be wrapped around the rigid member at the lower edge when it is retracted and then secured there when inserted in the friction-fit clamps.

Also included are means to secure the vertical position of the lower edge of said shade when extended. In the preferred embodiment, the rigid member comprises a cylinder and the ends of the cylinder each include a threaded end-cap. When extended, the bottom of the shade can be secured to the door track by using a wing nut bolt through a pre-drilled hole in the track and on each end of the shade. In this manner, most pets or children will be retained inside the garage for safety.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
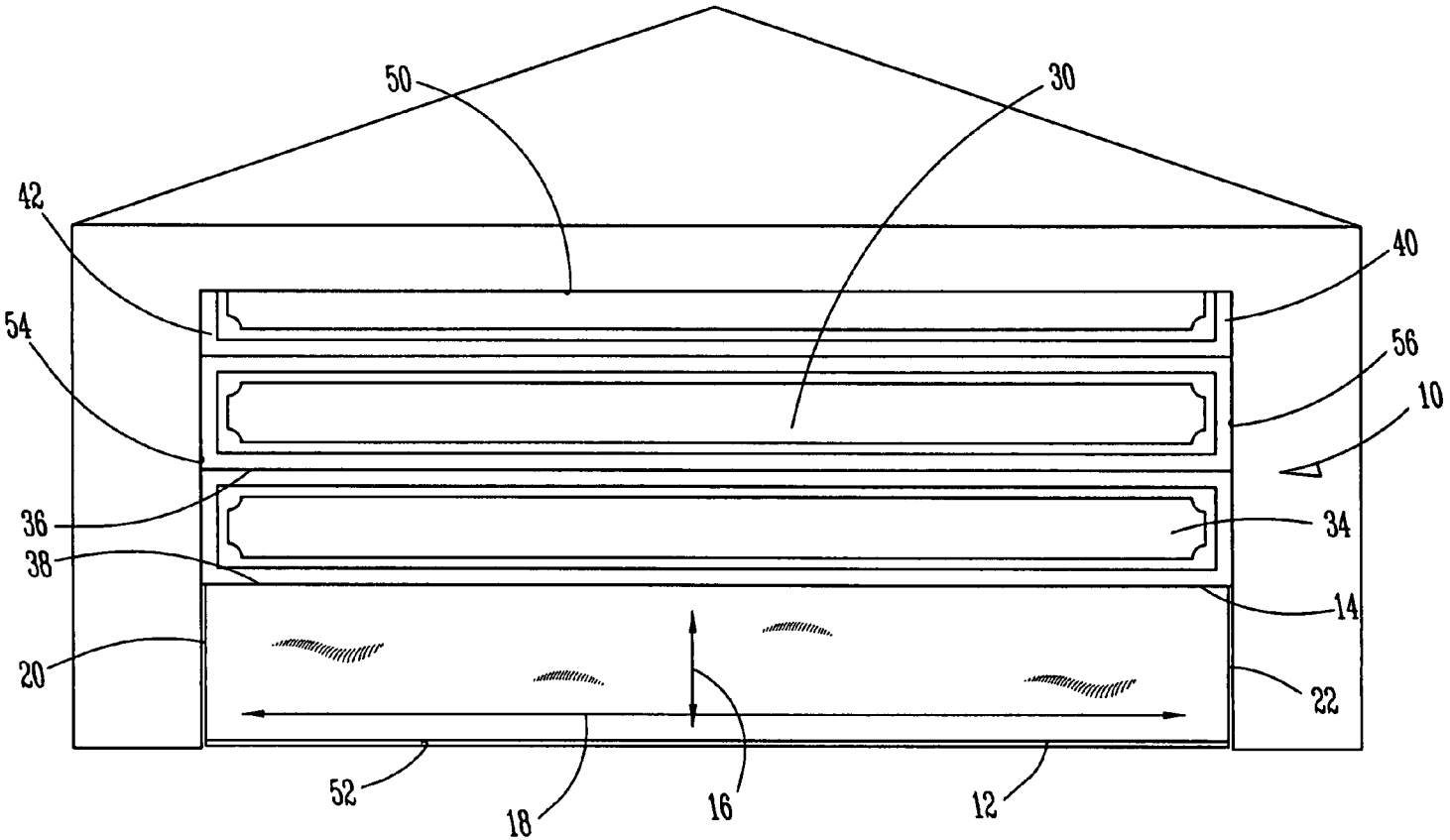
FIG. 1 is a perspective view of the present invention showing the shade in the extended position.
Figure 2:
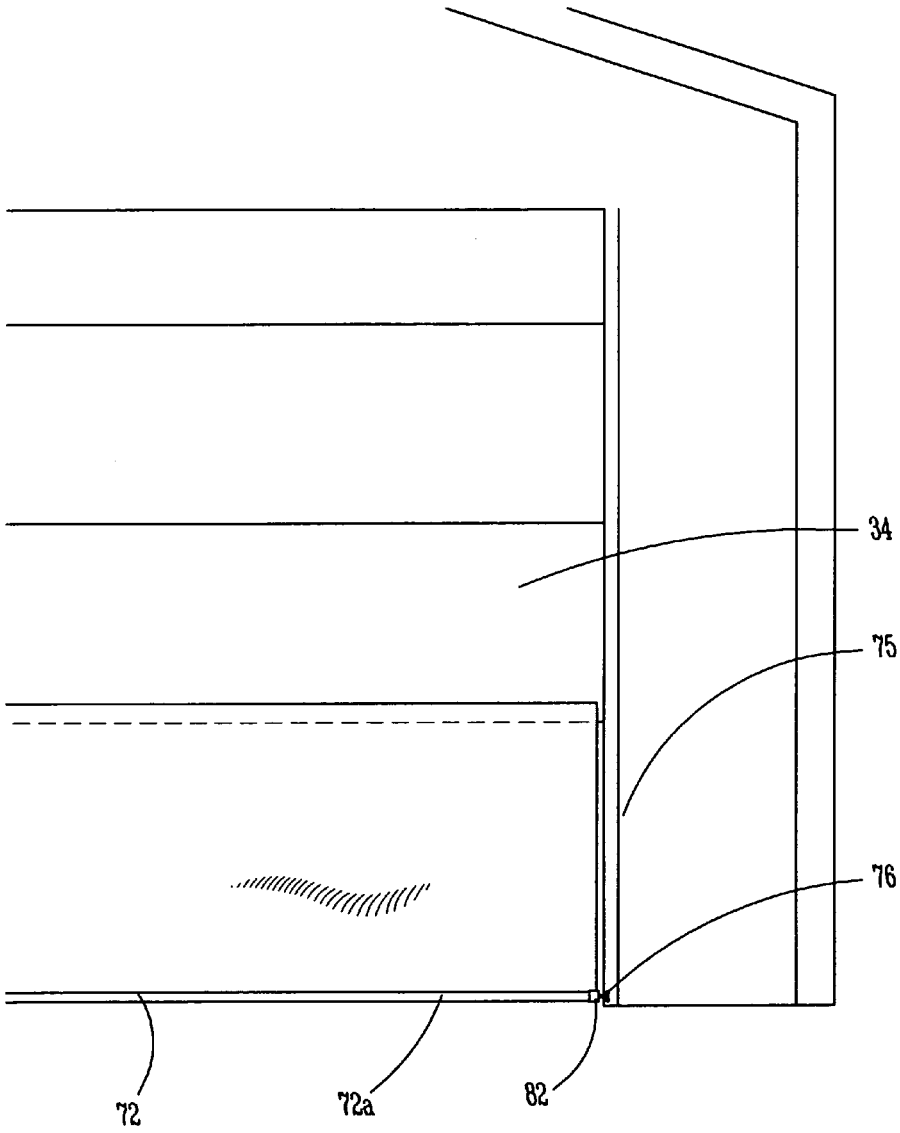
FIG. 2 is a perspective of the present invention showing the shade in the retracted position.
Figure 3:
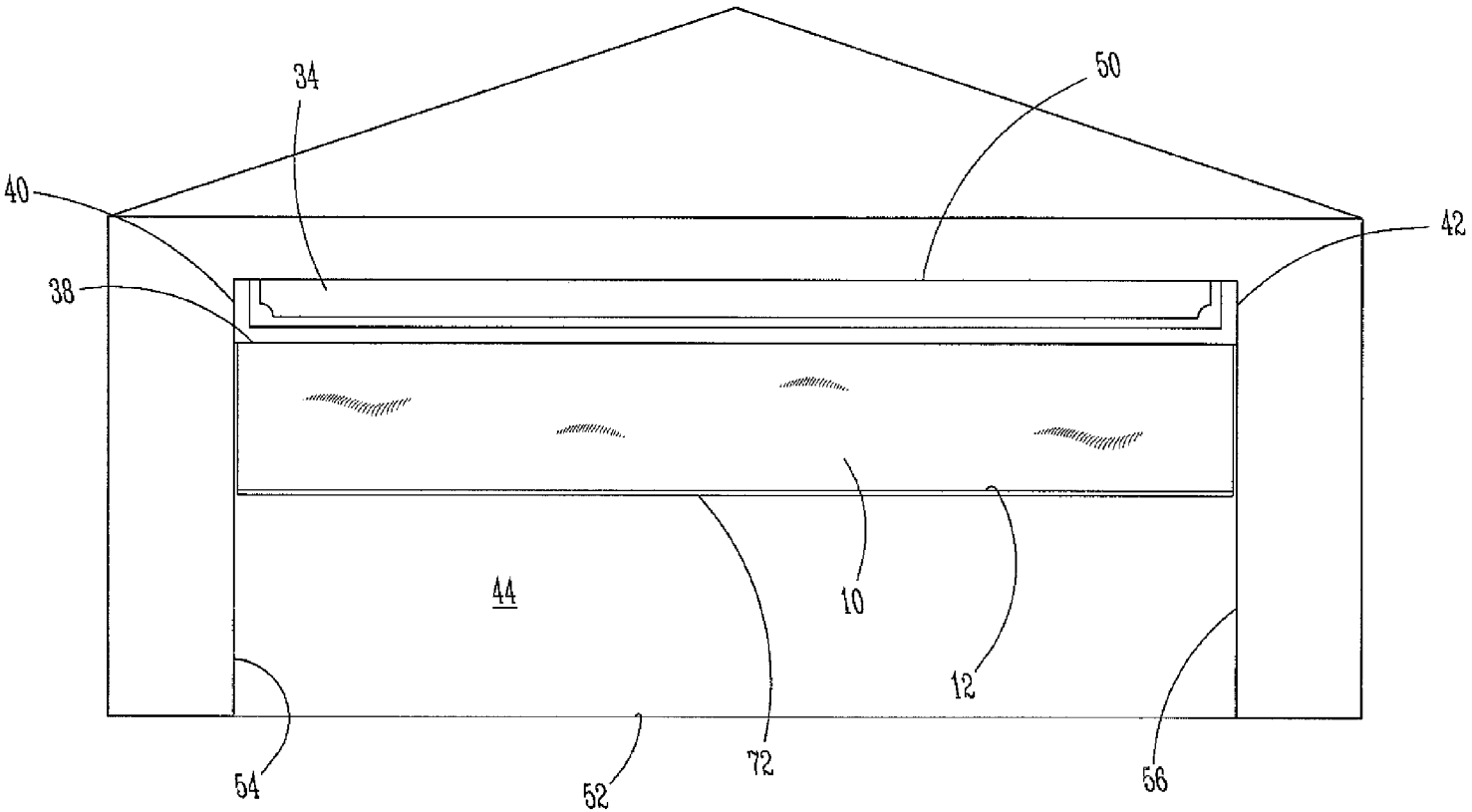
FIG. 3 is a perspective of the present invention shown in FIG. 3 without the shade.

The garage shade of the present invention is shown generally as 10 in FIG. 1. The frameless shade 10 comprises a lower edge 12, an upper edge 14, a height 16, a width 18, a first vertical side 20 and a second vertical side 22 and means for semi-permanently associating said upper edge 14 of the shade 10 with a garage door 30. Said garage door 30 comprises a lower panel 34 having a top boundary 36, a bottom boundary 38, and first side 40 and a second side 42 and means for slidable movement relative to a garage opening 44. In the preferred embodiment, said means for slidable movement 44 comprises a track element 46. Said garage opening 44 comprises a top side 50, a floor 52, a first opposing side 54 and a second opposing side 56.

Means for associating said upper edge 14 of the shade 10 with the garage door 30 comprises a rigid element 58 and at least one securing mechanism 62. In the preferred embodiment, said at least one securing mechanism 62 comprises self-tapping screws inserted through said rigid element 58 and spaced apart along said bottom boundary 38 of the lower panel 34.

Figure 4:
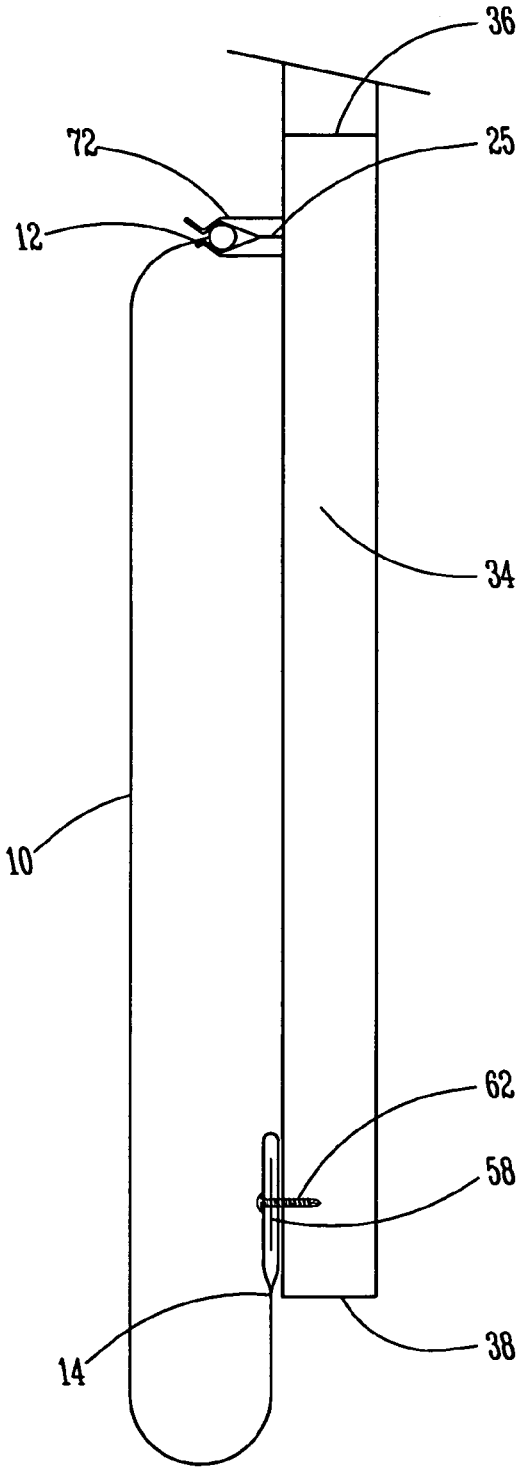
FIG. 4 is an end view of the shade of the present invention.

Said lower edge 12 of the shade 10 comprises means for appending a second rigid element 72. Said top boundary 36 of said panel 34 comprises means 25 for detachably securing said second rigid element 72 when said shade 10 is retracted. Means 25 for detachably securing said second rigid element 72 may include any of a number of known methods in the art, however, in the preferred embodiment, and as illustrated in FIG. 4, such means comprises at least one hand-operated friction-fit clamp mounted near said top boundary 36 of the panel 34 into which the second rigid element 72 is fitted when the shade is retracted.

Figure 5:
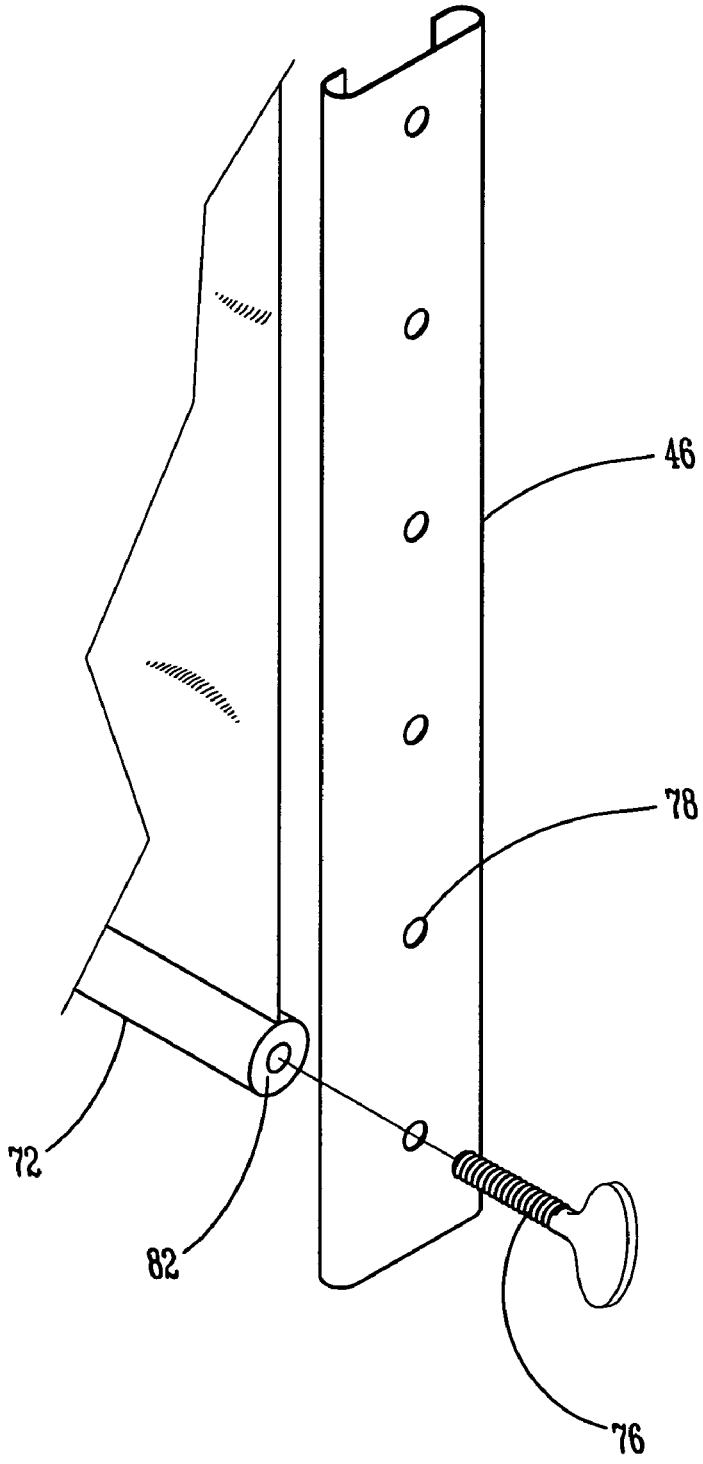
FIG. 5 is a close up front view of the preferred embodiment of the present invention showing its securement mechanism.
Figure 6:
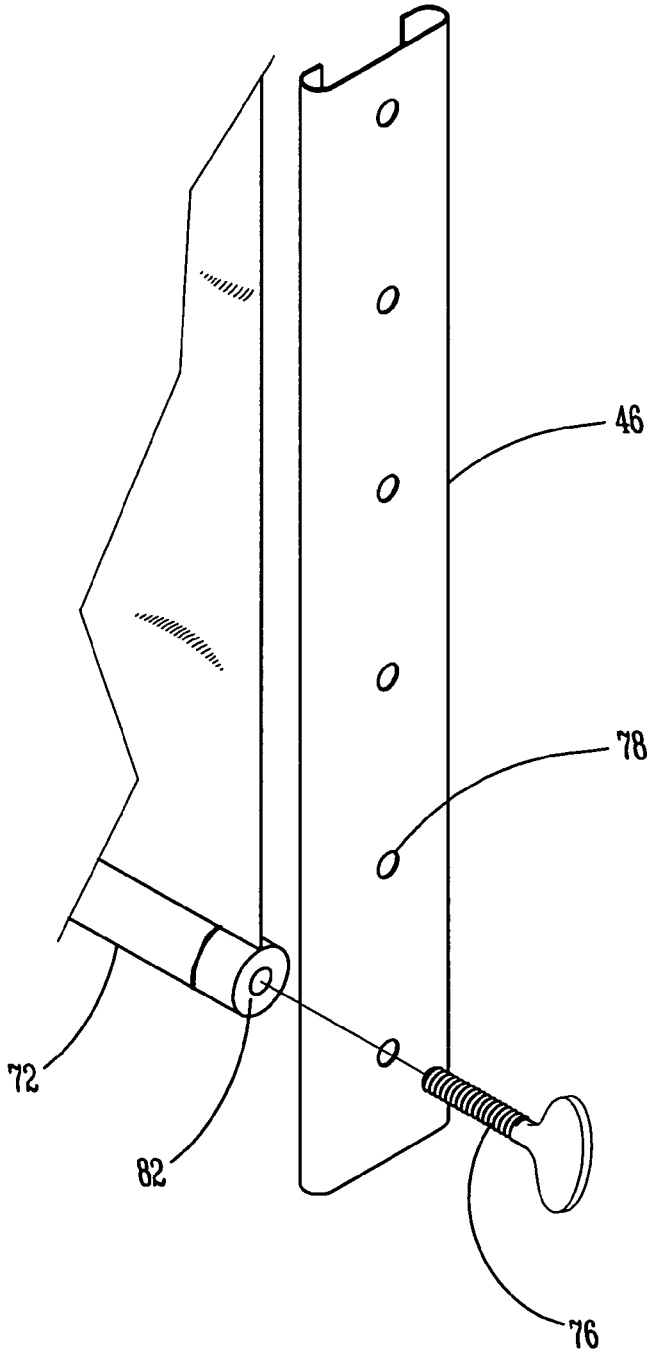
FIG. 6 is a close up front view of an alternative embodiment of the present invention showing its securement mechanism.

The preferred embodiment provides means 75 to secure the lower edge 12 of said shade 10 in a desired vertical position. One embodiment of the means 75 to secure the lower edge 12 comprises securing the second rigid element 72 to said track elements 46 such that when said shade 10 is extended, its lower edge 12 may be secured thereto. Said means 75 to secure the lower edge 12 comprises at least one wing nut bolt 76, and an opening 78 in said track element 46 for each said nut bolt 76. When said shade 10 is extended the desired length, said second rigid element 72 is aligned with said track element 46 and the wing nut and bolt assembly 76 is inserted in one of said openings 78 above said second rigid element 72 and secured therein. The vertical position of the second rigid element and the attached shade is thereby secured. In a second embodiment, means 75 to secure the lower edge 12 further comprises a threaded endcap 82 on each end of said second rigid element 72 (only one end is shown in FIG. 5). One wing nut bolt 76 is inserted in one of the openings 78 and aligned with threaded endcap 82 into which it is inserted and turned. A second wing nut bolt can be used in the same manner to secure the other end of second rigid element 72.

Thus, the present invention has been described in an illustrative manner. It is to be understood that the terminology that has been used is intended to be in the nature of words of description rather than of limitation.

Many modifications and variations of the present invention are possible in light of the above teachings. For example, the length of the shade element and the material with which it is made may be of a variety. Mechanisms for simple retraction and securing the shade in place may be any number of devices known in the art. Therefore, within the scope of the appended claims, the present invention may be practiced otherwise than as specifically described.

What is claimed is:

1. A garage door shade assembly comprising:

(a) a conventional, slidable overhead stored garage door, wherein said door comprises a lower panel having a bottom boundary and a top boundary, and at least one track element;

(b) said at least one track element further comprising a plurality of openings;

(c) a frameless shade comprising an upper edge comprising a rigid element attached to said bottom boundary and a lower edge comprising a rigid member;

(d) at least one wing nut bolt for directly appending said rigid member to said track element wherein one of said wing nut bolts is inserted through one of said openings and secured therein maintaining the vertical position of said rigid member when said shade assembly is extended;

(e) a first threaded end cap associated with a first end of said rigid member wherein at least one of said wing nut bolts rotates into said first end cap; and (f) means for detachably securing said rigid member near said top boundary of the lower panel of said door.

2. The garage door shade assembly of claim 1 wherein said means for detachably securing said rigid member comprises at least one hand-operated, friction-fit clamping device.

3. The garage door shade assembly of claim 1 wherein said rigid element consists of a bar-like member.

4. The garage door shade assembly of claim 3 wherein said garage door comprises a width and said rigid element comprises an aluminum bar of about one inch width and length about equal to the width of said garage door.

5. The garage door shade assembly of claim 1 wherein said rigid member is of pipe-like configuration.

6. The garage door shade assembly of claim 5 wherein said rigid member comprises PVC pipe.

7. The garage door shade assembly of claim 1 wherein at least one of said wing nut bolts is associated with a threaded end cap affixed to a first end of the rigid member.

8. The garage door shade assembly of claim 1 wherein said means for directly appending said rigid member to said track element further comprises another one of said at least one said wing nut bolts associated with a second threaded end cap on a second end of the rigid member wherein said second wing nut bolt is inserted through a second opening in said track element and rotates into said second end cap.

* * * * *